US006730263B2

(12) United States Patent
Ernst et al.

(10) Patent No.: US 6,730,263 B2
(45) Date of Patent: May 4, 2004

(54) PROCESS TO MANUFACTURE A SINTERED PART WITH A SUBSEQUENT SHAPING OF THE GREEN COMPACT

(75) Inventors: Eberhard Ernst, Eichenzell (DE); Bernhard Brust, Gersfeld (DE); Berthold Morber, Schönderling (DE); Wolfgang Schiemenz, Bad Brückenau (DE)

(73) Assignee: GKN Sinter Metals GmbH (DE)

( * ) Notice: Subject to any disclaimer, the term of this patent is extended or adjusted under 35 U.S.C. 154(b) by 0 days.

(21) Appl. No.: 09/847,116

(22) Filed: May 2, 2001

(65) Prior Publication Data

US 2002/0090314 A1 Jul. 11, 2002

Related U.S. Application Data

(63) Continuation of application No. PCT/EP99/08189, filed on Oct. 28, 1999.

(30) Foreign Application Priority Data

Nov. 2, 1998 (DE) ..... 19 50 326

(51) Int. Cl.[7] ..... B22F 5/08
(52) U.S. Cl. ..... 419/6; 419/38; 419/55
(58) Field of Search ..... 419/38, 36, 37, 419/6, 55

(56) References Cited

U.S. PATENT DOCUMENTS

| | | | | | |
|---|---|---|---|---|---|
| 2,540,457 | A | * | 2/1951 | Rice | 29/148 |
| 2,542,912 | A | * | 2/1951 | Ensign | 29/34 |
| 3,665,585 | A | * | 5/1972 | Dunn et al. | 29/420 |
| 5,009,842 | A | * | 4/1991 | Hendrickson et al. | 419/28 |
| 5,215,946 | A | * | 6/1993 | Minh | 501/97 |
| 5,390,414 | A | * | 2/1995 | Lisowsky | 29/893.34 |
| 5,453,242 | A | * | 9/1995 | Knoess | 419/27 |
| 5,659,955 | A | * | 8/1997 | Plamper | 29/893.32 |
| 5,681,783 | A | * | 10/1997 | Nilsson et al. | 501/87 |
| 5,762,843 | A | * | 6/1998 | Massa et al. | 264/60 |
| 5,884,527 | A | * | 3/1999 | Cole et al. | 74/434 |
| 5,903,815 | A | * | 5/1999 | Scott | 428/564 |
| 6,044,555 | A | * | 4/2000 | Jacob et al. | 29/893.34 |
| 6,110,419 | A | * | 8/2000 | Buckley-Golder et al. | 419/28 |
| 6,361,737 | B1 | * | 3/2002 | Miyasaka et al. | 419/2 |

FOREIGN PATENT DOCUMENTS

| | | |
|---|---|---|
| DE | 3325037 | 12/1984 |
| EP | 0 370 562 | 11/1989 |
| GB | 2 051 639 A | 6/1980 |
| WO | WO 92/05897 | 4/1992 |

* cited by examiner

*Primary Examiner*—Daniel Jenkins
(74) *Attorney, Agent, or Firm*—Woodcock Washburn LLP

(57) ABSTRACT

The invention relates to a method for producing a sintered part comprised of a powdery material, especially comprised of a sintered metallurgical powder. According to the inventive method, a green compact which forms an elementary shape of the part is firstly compression molded from the powder. The desired final shape of the part is produced by subjecting partial areas of the elementary shape on the green compact to a successive non-cutting shaping. Afterwards, said final shape is finished by sintering.

16 Claims, 7 Drawing Sheets

Figure 1:
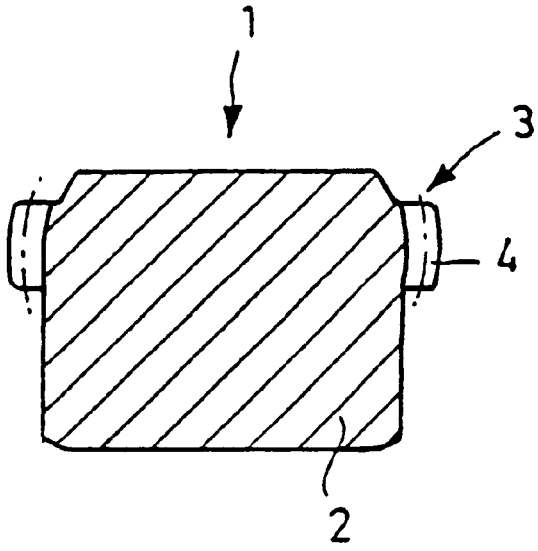

PROCESS TO MANUFACTURE A SINTERED PART WITH A SUBSEQUENT SHAPING OF THE GREEN COMPACT

This application is a continuation of PCT/EP99/08189, filed Oct. 28, 1999.

This invention pertains to a process to manufacture a sintered part from powdered material, in particular sinterable metallurgical powder.

The manufacture of sintered parts by pressing a metallurgical powder and then sintering is basic knowledge. When the powder is pressed into a so-called green compact, the quality of the compact depends for one thing on attaining as even a compaction of the powder as possible and on the other hand the geometry of the part must be designed such that the shaping can be carried out with as simple pressing tools as possible. Moreover, the requirement exists in that the pressed green compact can be removed from the press form. Many times, however, the functional requirements of the geometry of the finished part can not be accomplished using a press process if, for example back-tapers, notches running perpendicular to the pressed direction or external contours are present that do not allow an even compaction. To some extent, the problems can be solved by assembling the finished part from two or more sections pressed and sintered individually or by producing a raw part by pressing and sintering. This raw part must then be finished in a machine-shaping process. To construct a part made up of a number of element sections cannot always be accomplished. Machining of a finished sintered part is cost intensive, especially when used in volume production.

A process to manufacture prototypes is known from DE-A-196 36 524 in which a green compact is formed as a basic form of the part in a first single-stage basic forming process from a metal powder that contains binders. Pressure and/or heat are used here. In at least one other material-removal forming process, the green compact is then provided with the desired final form of the part and it is then sintered. The working of a green compact using material-removal shaping processes to produce the final form to be sintered is not applicable for volume production due to the high unit costs.

In order to combine a shaping process with the basic forming process using pressing technology to manufacture a sintered part, a process is described in EP 826 449 in which a green compact is formed in its final form from powdered material using a number of special punches that follow in sequence in a pressing tool. Right at pressing, staged cross sectional contours can be applied with different material thicknesses such as wheel hubs and rims. The prerequisite is that the part's geometry must have no back-tapers so that it can be removed from the pressing tool again after pressing.

In principle, however, this process can be used for any geometry that has no back-tapers if the pressing tool is adjusted to the contours accordingly. Nonetheless, it has been shown that only for bodies with surfaces that are directed essentially perpendicular to the direction of motion of the pressing tools can an even compaction be attained. As soon as the part to be produced has geometries deviating from this basic condition, the process described runs up against technical limits.

In particular, at the edges and bosses of the part to be produced, areas with less material density can arise due to the low flowability of the powder. This can result in material errors when sintering is subsequently performed such as tears or breaks. In the same manner, overloads and thus breaks can occur at these types of exposed points on the pressing tool.

For parts whose contours or geometries have section that can not be produced using an axially moving pressing tool, either a complicated, a sectional pressing tool is required, for example having lateral slides as well, or it is necessary to do a special process after the basic forming process. In material-removal work, the corresponding geometries or back-tapers on the part are done through machining to attain the final desired form of the part.

The objective of this invention is to create a process that avoids the disadvantages described above.

The objective of met by means of a process to manufacture a sintered part from powdered material, in particular from a sinterable metallurgical powder, in which, first of all, a green compact is pressed, forming a basic form of the part, and in which the desired final form of the part is produced by at least one subsequent non-machined modification of sections on the basic form of the part, which is then finish-sintered. This process offers the advantage for a number of geometries in that the green compact can be made in a relatively simple pressing tool designed for an even compaction. It is useful if the geometry of the basic form of the part approximates the geometry of the final form of the part as much as possible. The specialized final form of the part is then accomplished by means of at least one more special modification of the affected sections of the green compact using another modification tool.

In an embodiment of the process according to the invention, it is provided that the sections to be modified are subjected to pressure in special modification tools. Here, areas that were less compacted in the first pressing step can be compressed again subsequently. Special geometries in the sections of the basic form of the part that are not formed in the first pressing step, or are difficult to form, can be modified. The modification tools are equipped with pressure and counterpressure means. In this method of processing, an amount of isostatic pressure can be transferred to the section to be modified such that even with very brittle material it is still possible to deform it. By modifying the affected sections of the green compact, the final form of the part is produced that can be then sintered.

According to the geometry of the part, it is even possible to even raise the material density in sections by means of the subsequent modification and thus to attain an additional strength in these sections in the finished sintered part.

In an embodiment of the process according to the invention, the modification can be done by means of pressing and/or rolling. The modification can in particular be done in steps, wherein individual contours, such as back-tapers can be produced on the final form of the part through at least one modification stage.

According to the invention, it is also provided that the modified depth increases in steps. In the process, larger modification work can be applied without destroying the material matrix.

In another advantageous embodiment of the process, the green compact is pre-sintered prior to at least one modification to raise the green strength. This joining of the powdered, pressed powder material, called pre-sintering, is preferred to be done at a lower temperature than the high[-temperature] sintering that leads to the final form of the part. The pre-sintering is done in such a manner that it is still possible to do more modification work on the part. By pre-sintering, the inner grain structure of the formed part in the sections that are already in their final form is largely retained when the [other] sections are modified and an increased pressure can be applied to these sections for modification.

According to the invention, the part can be calibrated as a green compact prior to sintering and/or as a solidified part after sintering. It is particularly also provided to apply at least a part of the modification work through calibrating. By this calibration, the surface can be qualitatively improved, as can the grain structure of the part. It is particularly possible to remove ridges and/or peaks or sharp edges.

Figure 3:
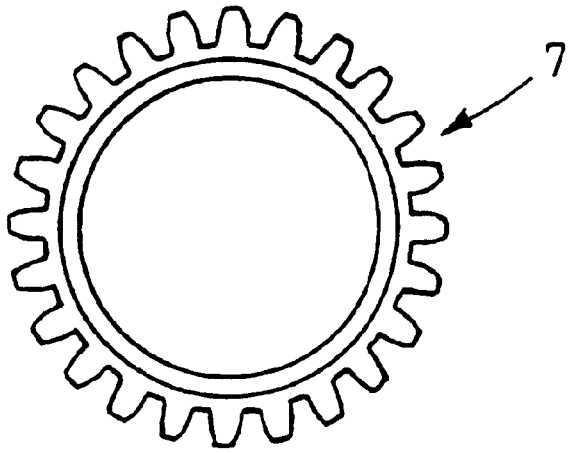
Figure 5:
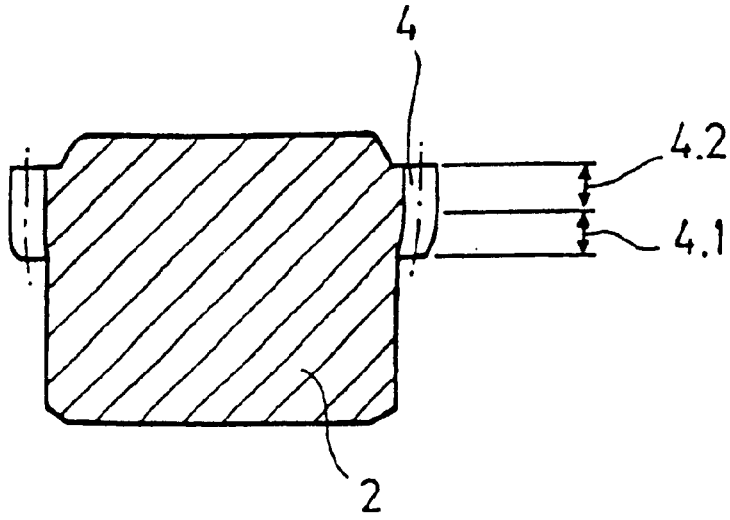
Figure 2:
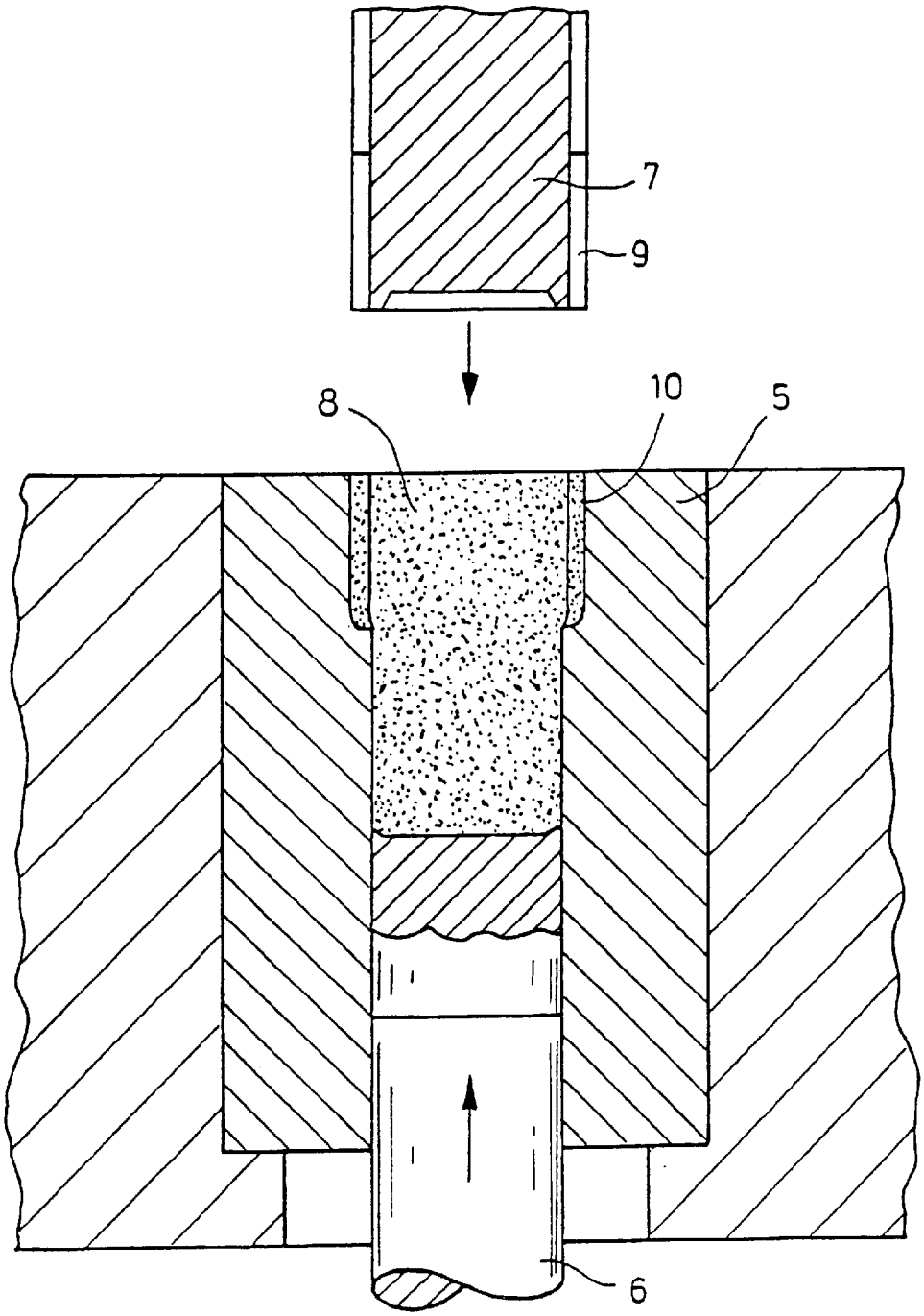
Figure 4:
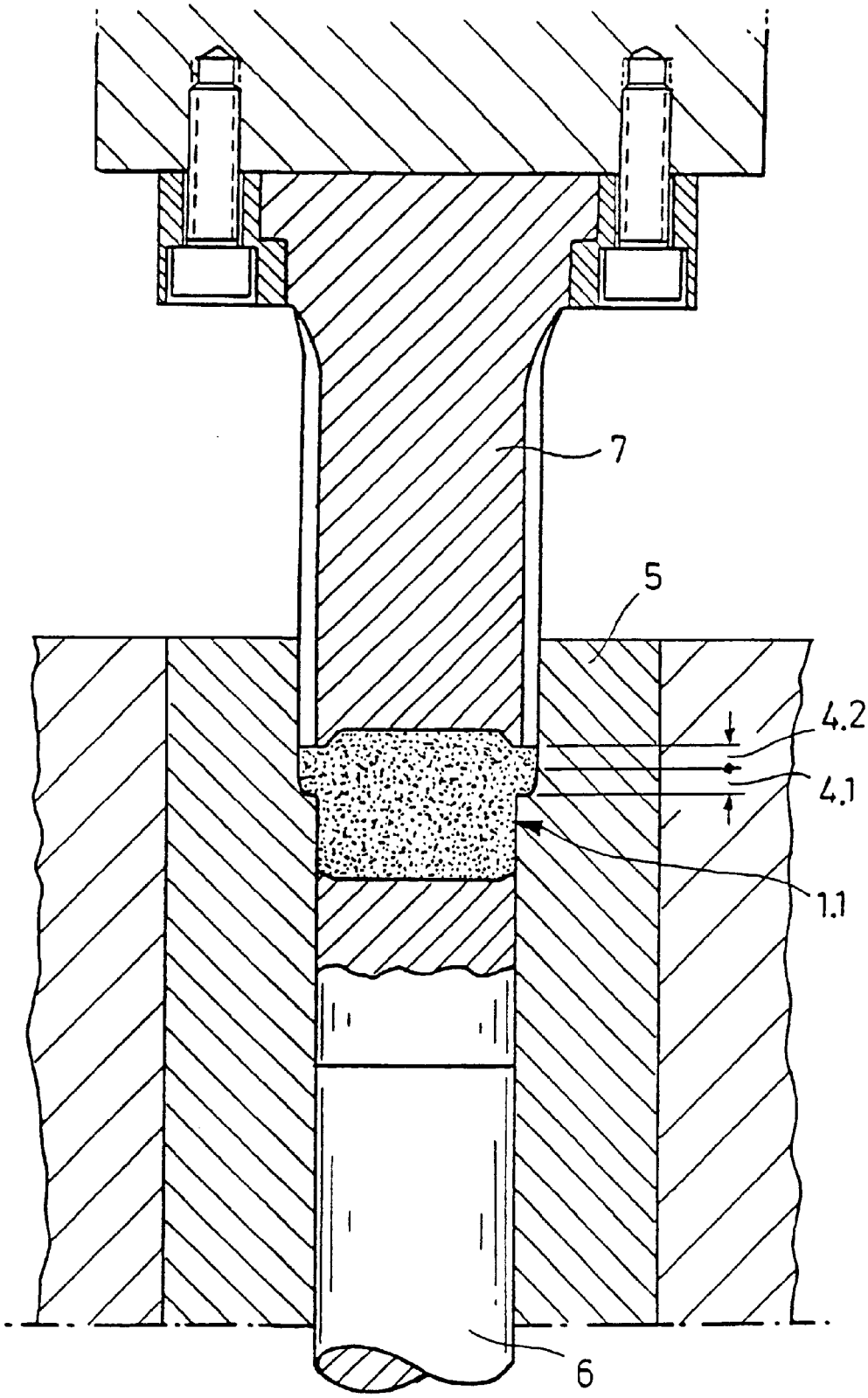

The invention is explained in more detail with the help of schematic drawings. Shown are:

FIG. 1 a pinion with bent teeth as a finished part,

FIG. 2 filling the press form to produce the pinion according to FIG. 1, FIG. 3 an end view of a punch to produce the part according to FIG. 1, FIG. 4 the first pressing step, FIG. 5 the form of the green compact formed in the pressing step according to FIG. 4

Figure 6:
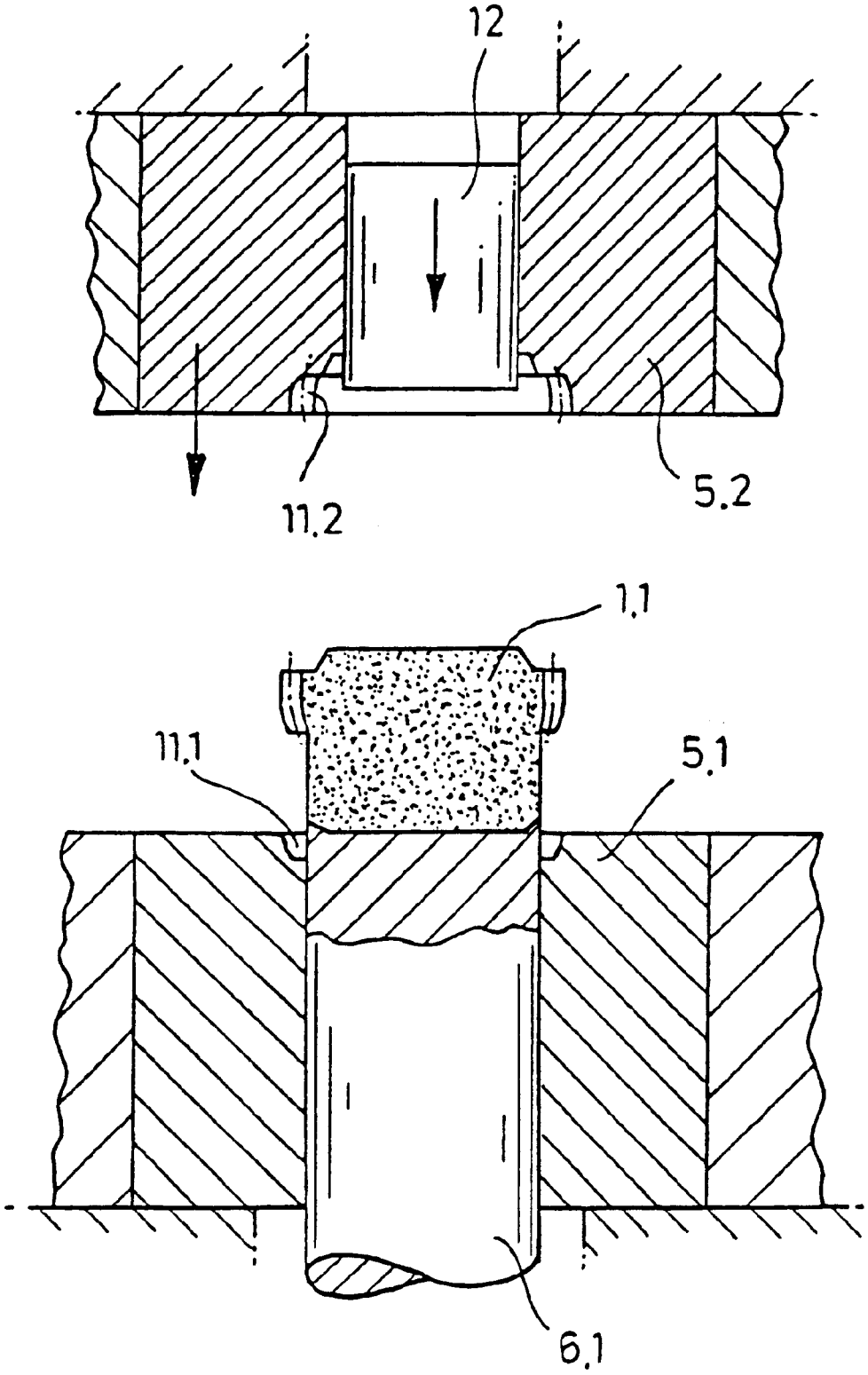
Figure 7:
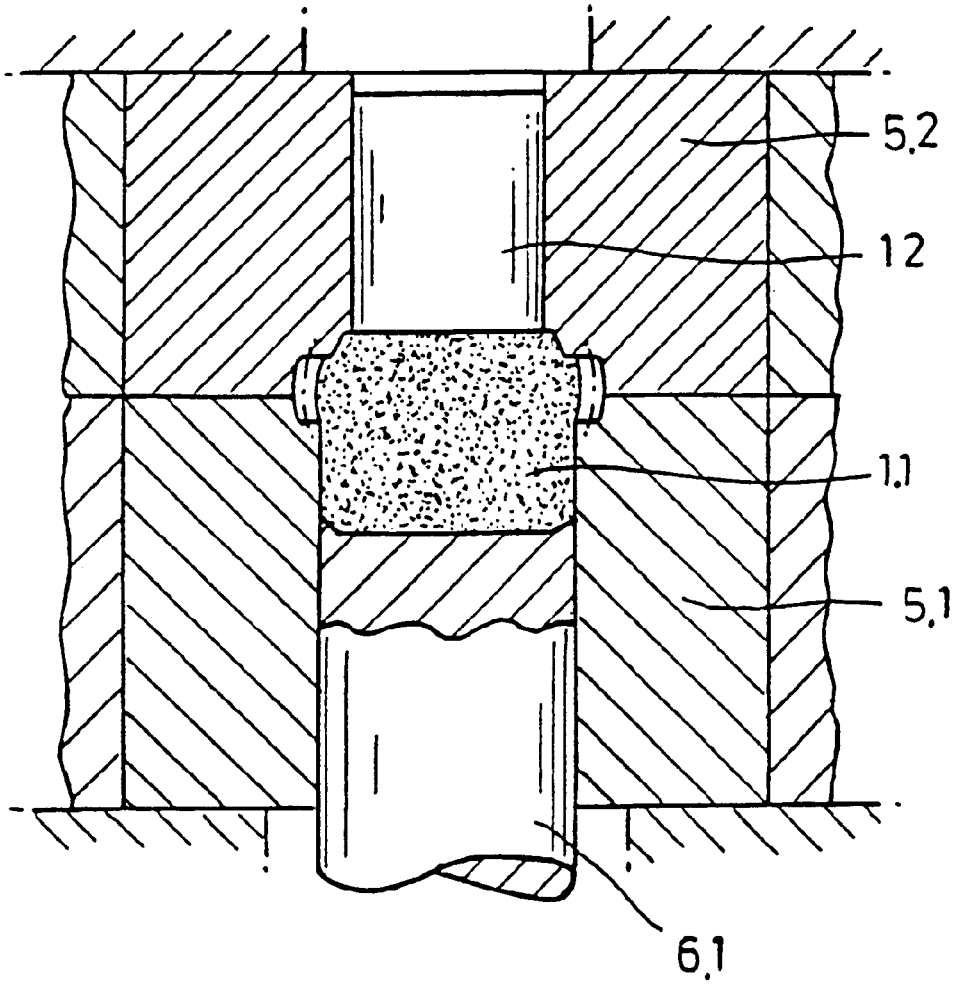
Figure 9:
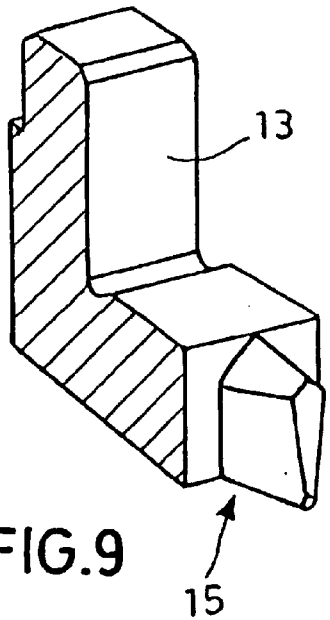
Figure 8:
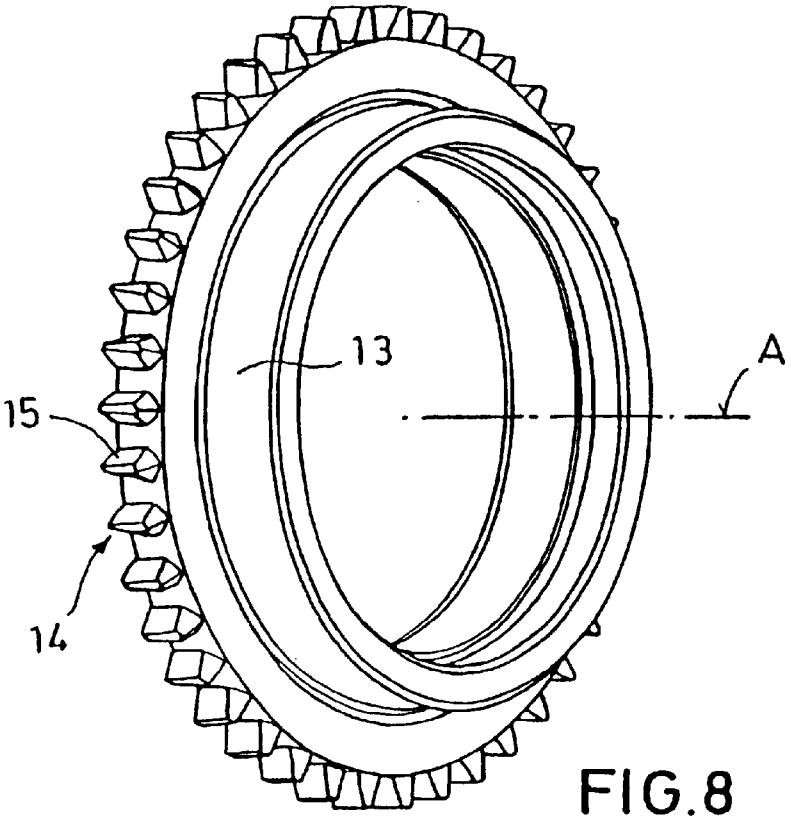

FIG. 6 the green compact according to FIG. 5 in the press tool to perform the modification FIG. 7 the press tool according to FIG. 6 in the modification position, FIG. 8 a perspective of a cog ring FIG. 9 a enlarged section of a tooth of the cog ring according to FIG. 8

Figure 10:
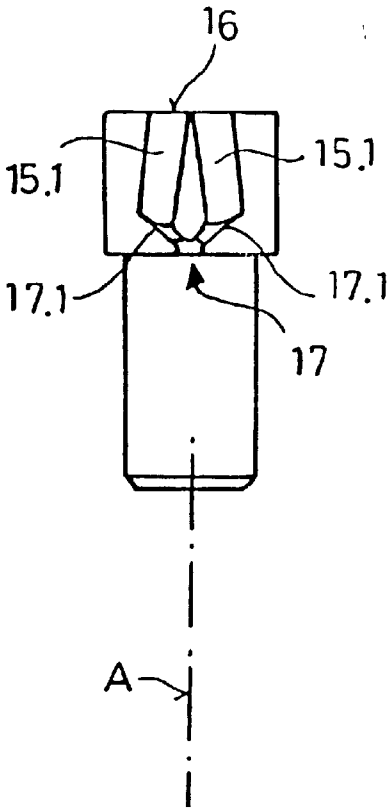

FIG. 10 a top view of the section according to FIG. 9

Figure 11:
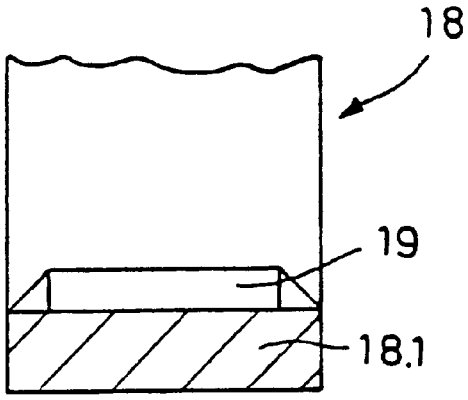
Figure 12:
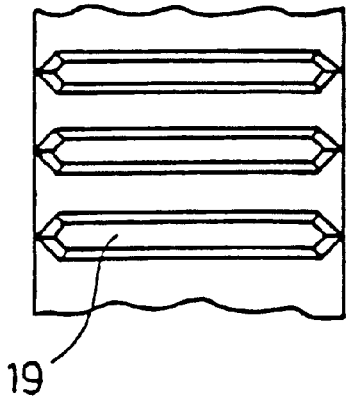
Figure 14:
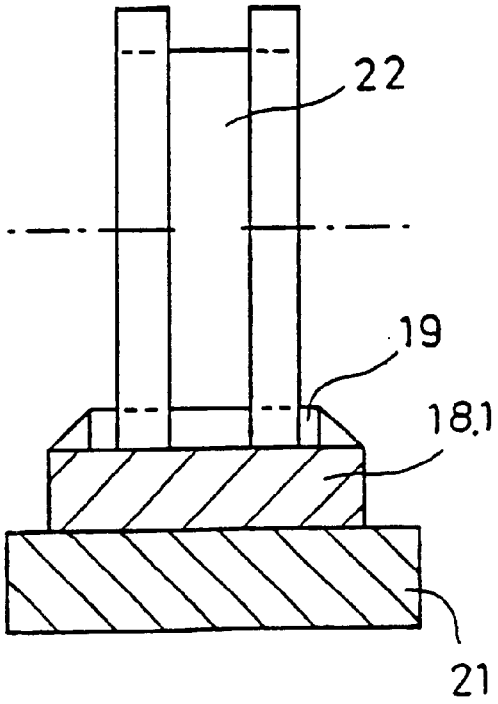
Figure 13:
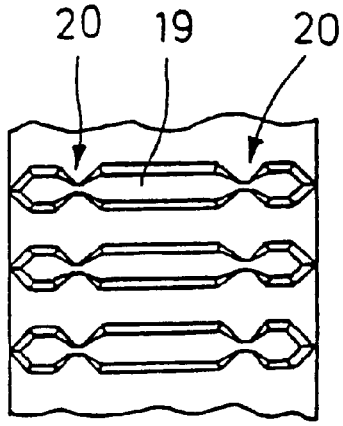

FIG. 11 a green compact for a cog ring with a back-tapered inner cogging after the first pressing step, FIG. 12 a development of the inner cogging on the green compact according to FIG. 11, FIG. 13 the inner cogging in the view according to FIG. 12 after modification, FIG. 14 the modification pressing process in FIG. 13.

In FIG. 1, pinion 1 is shown in a longitudinal section. This pinion has a cylindrical body 2 that is provided at one end with an outer cogging 3. As can be seen in FIG. 1, the teeth 4 of the outer cogging 3 are designed as so-called bent cogs. This part is produced in a sintering process from a sinterable metallic powder. FIG. 1 shows the part in the final sintered state.

In FIGS. 3, 4, 6, and 7, the process steps in the pressing tool involved in producing the part according to FIG. 12 are shown in more detail.

As seen in FIG. 2, the press tool consists essentially of a die 5 that encompasses essentially the outer contour, a lower ram 6 and an upper punch 7. The lower ram 6 is first lowered to a prescribed level for filling. The form cavity thus created is filled with sinterable metallurgical powder 8. Then, the punch 7 is lowered. Its outer contour 9 corresponds essentially with the inner contour 10 of the upper area of the die 5. FIG. 3 shows an end view of the punch 7.

As seen in FIG. 4, in the next step, the punch 7 is introduced into the die 5 and at the same time the lower ram 6 is moved upward so that punch and lower ram are moved opposite to one another, thus compacting the gravity-fed powder fill into a solid green compact 1.1. The cylindrical body 2 is already at its final form here, whereas the lower section 4.1 of the teeth 4 of the outer cogging 3 already has the bent cog shape due to the corresponding shape of the die 5. The upper area 4.2 has the contour of a normal straight cog.

The intermediate form of the green compact so produced is seen in FIG. 5. Here, it can also be seen that after lifting up the punch 7, the green compact 1.1 can be pushed out of the die 5 by the lower ram 6, since no back-tapering is present.

As seen in FIG. 6, in a second step, the green compact 1.1 is placed into a die 5.1 that has a lower ram 6.1, and whose form cavity is essentially a tooth form cavity 11.1 that corresponds in its geometry to the area 4.1 of the green compact (FIG. 2).

An upper die-shaped pressing tool, 5.2 is provided with a tooth form cavity 11.2 that is shaped identical to the area 4.1 on the green compact (FIG. 5) and that is used to modify the area 4.2 on the green compact that is shaped as a straight cog such that this area of the tooth obtains the final contour shown in FIG. 1.

An inner ram 12 is included with the upper die-shaped tool 5.2 so that when the entire tool arrangement is run as a whole, the lower ram 6.1 and the inner ram 12 can be moved such that, other than the modification of the outer cogging, no relative shift of the green compact between the two tools 5.1 and 5.2 occurs. This press situation is shown in FIG. 7.

If the geometry of the punch 7 as shown in FIGS. 2 and 3 is compared, it can be seen right away that the area of the tooth 4.2 can not be formed using a simple punch in the manner given previously, since this would flow out in tongue-like peaks so that neither the required pressing pressures nor the required stability of the tools exists. Surprisingly, it has been shown that using this multi-staged pressing process, the complicated tooth geometry as can be seen in FIG. 1 can be performed with high precision and even compaction of the powder if the green compact is partially modified using a die-shaped forming tool that wraps around the cogging in this area 4.2, which is only preformed, and enables the application of high pressing forces and possibly even subsequent compaction of the green compact in the area of the outer cogging.

Surprisingly, it has been shown that it is possible to make this type of modification of sections of a finished pressed green compact, which leads to very good results with respect to material density and form precision.

Below, more examples of parts are shown that can be produced by means of the process according to the invention. FIG. 8 shows a perspective of a ring 13 with an outer cogging 14 as is used, for example as a coupling in a manual transmission. As FIG. 8 shows, and shown even more so in the enlarged perspective view in FIG. 9 and in the view in FIG. 10, the individual teeth 15 of the outer cogging 14 are not designed as common straight teeth, but have a complicated geometric form. The flanks of the teeth 15.1 are formed as involute surfaces, but sit at an angle with respect to one another—as shown in FIG. 10. End surface 16 is a flat surface here, whereas end surface 17 is formed from two surface areas 17.1 that are tilted with respect to one another but are nonetheless flat.

Since the plane of the pressing tool needed to manufacture this part is directed perpendicular to the axis A of the part, i.e. the required punches are moved in the direction of the axis A, it can be seen especially in FIG. 10 that this type of cogging can not be formed using a simple punch due to the back-tapering that it has. Also, in manufacturing of this part, it can be done such that in a first forming step, the ring and the outer cogging is formed together with the end surfaces 17.1 so that the adjacent lateral surfaces 15.1 are designed as "straight cogging". In the second modification step, then, the final forming of the tooth flanks 15.1 is done, again with a die-shaped tool, on the already pressed green compact, wherein not only the opposing tilt is formed in the axial direction but also the involute surfaces are as well.

In FIG. 11, a green compact 18 is shown as another design example of a ring with an inner cogging. The green compact shown in FIG. 11 is produced similar to the process described using FIGS. 2 and 4 as a basic form of the part. In the sectional diagram according to FIG. 11, only one tooth 19 of the inner cogging is shown on a ring 18.1 in a side view and in FIG. 12, a number of teeth 19 are shown in a development of the inner cogging in a top view. This type of green compact contour can be produced in a first pressing step similar to the representation according to FIGS. 2 and 4 as a basic form of the part, including the special contouring of the teeth 19.

However, the application shown here as an example needs a tooth shape with back-tapering as is shown in FIG.

13. This tooth shape can no longer be produced using a pure pressing process due to the back-tapers 20 on both sides of the tooth flanks. This is however possible by means of the process according to the invention by using a modification procedure that—as shown in FIG. 14—is possible through a rolling process. Here, the green compact 18 is held on a rotating counter element 21, for example a roll or in a support ring. The back-tapers 20 are then produced through modification using a correspondingly formed rolling tool 22 as a pressing element, which [rolls off] when the counter element 21 rotates onto the inner surface of the cogging. For reasons of illustration, the back-tapers 20 in FIG. 13 are shown coarsely. In practical application, these are only minimal indentations in the adjacent areas of the tooth flanks.

According to the process according to the invention, other back tapers and embodiments can also be formed through modification that cannot be produced in a "classical" pressing process. This includes practically all forms that require pressing forces that run essentially perpendicular to the pressing direction necessary to produce the basic form of the part according to FIGS. 3 and 4, for example.

What is claimed is:

1. A method of making a metallurgical part comprising the steps of:

(a) compacting a metallurgical powder to form a green compact having a first portion and at least one second portion extending outward from the first portion and integrally connected thereto, said at least one second portion having a first shape;

(b) separately compressing the green compact so that at least one second portion is shaped by pressure to a second shape that is different then the first shape such that the second portion is still integrally connected to the first portion; and (c) sintering the green compact.

2. The method of making a metallurgical part of claim 1 wherein the green compact is compressed by a modification tool having a pressure and counter pressure means.

3. The method of making a metallurgical part of claim 1, further comprising the step of modifying the shape of the first or second portions of the green compact by pressing, rolling, or both.

4. The method of making a metallurgical part of claim 1 wherein the shape of the second portion of the green compact is modified to have backtapers.

5. A method of making a metallurgical part comprising the steps of:

(a) compacting a metallurgical powder to form a green compact having a first portion and at least one second portion extending outward from the first portion and integrally connected thereto, said at least one second portion having a first shape;

(b) separately modifying the green compact by compression so that at least one second portion is shaped by pressure to a second shape that is different then the first shape such that the second portion is still integrally connected to the first portion wherein the green compact is pre-sintered prior to at least one modification to raise the green strength; and (c) sintering the green compact.

6. The method of making a metallurgical part of claim 1, further comprising the step of calibrating the part before sintering, after sintering, or both.

7. The method of making a metallurgical part of claim 1, wherein the green compact is not machined prior to sintering.

8. The method of making a metallurgical part of claim 1, wherein compressing the green compact increases the material density, green strength, or both of the second portion of the green compact.

9. A method of making a metallurgical part comprising the steps of:

(a) compacting a metallurgical powder to form a green compact having a first portion and at least one second portion extending outward from the first portion and integrally connected thereto, said at least one second portion having a first shape;

(b) pre-sintering the green compact;

(c) compressing the green compact so that the second portion is shaped by pressure to a second shape that is different then the first shape such that the second portion is still integrally connected to the first portion; and (d) sintering the green compact.

10. The method of making a metallurgical part of claim 1, wherein the at least one second portion is shaped by isostatic pressure.

11. A method of making a metallurgical part comprising the steps of:

(a) compressing a metallurgical powder to form a green compact comprising:

a cylindrical portion having an outer surface, a plurality of cogs extending from the outer surface of the cylindrical portion and integrally connected thereto, each of said plurality of cogs having a first shape;

(b) separately compressing the green compact so that at least one cog is shaped by pressure to a second shape that is different from the first shape such that the plurality of cogs are still integrally connected to the cylindrical portion; and (c) sintering the green compact.

12. The method of making a metallurgical part of claim 11, wherein the plurality of cog portions are cog teeth having a shape with backtapered contours.

13. The method of making a metallurgical part of claim 11, wherein the green compact is compressed by a press tool comprising:

a lower die portion having a cavity corresponding in geometry to the shape of a cog of the metallurgical part; and an upper die portion pressing tool having a cavity corresponding in geometry to the shape of a cog of the metallurgical part; and an inner ram.

14. The method of making a metallurgical part of claim 12, wherein the inner ram and the lower die portion contact the green compact thereby preventing the green compact from moving relative to the plurality of cogs while the green compact is compressed by the press tool.

15. The method of making a metallurgical part of claim 11, wherein the metallurgical part is a coupling in a transmission.

16. The method of making a metallurgical part of claim 11, wherein the at least one cog is shaped by isostatic pressure.

* * * * *